US010959594B2

(12) United States Patent
Caro, Jr. et al.

(10) Patent No.: US 10,959,594 B2
(45) **Date of Patent: *Mar. 30, 2021**

(54) VACUUM CLEANER WITH FLUID DISTRIBUTION SYSTEM

(71) Applicant: BISSELL Homecare, Inc., Grand Rapids, MI (US)

(72) Inventors: Victor Vito Caro, Jr., Hudsonville, MI (US); Alexander Joseph Reed, Rockford, MI (US)

(73) Assignee: BISSELL Inc., Grand Rapids, MI (US)

( * ) Notice: Subject to any disclaimer, the term of this patent is extended or adjusted under 35 U.S.C. 154(b) by 258 days.

This patent is subject to a terminal disclaimer.

(21) Appl. No.: 16/163,082

(22) Filed: Oct. 17, 2018

(65) Prior Publication Data

US 2019/0045996 A1 Feb. 14, 2019

Related U.S. Application Data

(63) Continuation of application No. 15/712,789, filed on Sep. 22, 2017, now Pat. No. 10,130,235, which is a continuation of application No. 14/330,527, filed on Jul. 14, 2014, now Pat. No. 9,820,627.

(60) Provisional application No. 61/847,212, filed on Jul. 17, 2013.

(51) Int. Cl.
*A47L 11/40* (2006.01)
*A47L 11/283* (2006.01)

(52) U.S. Cl.
CPC ..... *A47L 11/4083* (2013.01); *A47L 11/4027* (2013.01); *A47L 11/4088* (2013.01); *A47L 11/283* (2013.01)

(58) Field of Classification Search
CPC . A47L 11/283; A47L 11/4088; A47L 11/4083
See application file for complete search history.

(56) References Cited

U.S. PATENT DOCUMENTS

| | | | | |
|---|---|---|---|---|
| 5,500,977 | A * | 3/1996 | McAllise | A47L 7/0009 15/320 |
| 5,799,361 | A * | 9/1998 | Reed | A47L 11/34 15/320 |
| 5,867,861 | A * | 2/1999 | Kasen | A47L 7/0009 15/320 |
| 6,399,188 | B1 | 6/2002 | Smith | |
| 7,824,456 | B1 | 11/2010 | Monson | |
| 8,375,506 | B2 * | 2/2013 | Chaney | A47L 11/34 15/320 |
| 8,631,538 | B2 | 1/2014 | Huffman | |
| 9,320,402 | B2 * | 4/2016 | Krondorfer | A47L 11/34 |
| 10,130,235 | B2 * | 11/2018 | Caro, Jr. | A47L 11/4088 |
| 2003/0019070 | A1 | 1/2003 | Joynt | |

(Continued)

FOREIGN PATENT DOCUMENTS

GB 2427351 A1 12/2006

*Primary Examiner* — Michael D Jennings
(74) *Attorney, Agent, or Firm* — McGarry Bair PC

(57) ABSTRACT

A vacuum cleaner is provided with a dispensing system for applying a treating agent stored on the vacuum cleaner to the surface to be cleaned. The dispensing system can include at least one container for storing a supply of treating agent and a dispenser for dispensing the treating agent to the surface to be cleaned. The dispensing system uses filtered working exhaust air to blow treating agent off the treating agent dispenser.

20 Claims, 7 Drawing Sheets

(56) References Cited

U.S. PATENT DOCUMENTS

| | | | | |
|---|---|---|---|---|
| 2005/0160553 | A1* | 7/2005 | Gregory | A47L 7/0009 15/320 |
| 2006/0150362 | A1 | 7/2006 | Mitchell | |
| 2007/0186957 | A1 | 8/2007 | Gronlund | |
| 2009/0165822 | A1 | 7/2009 | Kintz | |
| 2011/0056044 | A1* | 3/2011 | Reed, Jr. | B04C 5/04 15/320 |
| 2011/0104401 | A1 | 5/2011 | Hsueh | |
| 2012/0066858 | A1 | 3/2012 | Krondorfer | |
| 2012/0118319 | A1 | 5/2012 | Stuchlik | |
| 2012/0204377 | A1 | 8/2012 | Krebs | |
| 2014/0259514 | A1 | 9/2014 | Bantum | |

* cited by examiner

VACUUM CLEANER WITH FLUID DISTRIBUTION SYSTEM

CROSS-REFERENCE TO RELATED APPLICATION

This application is a continuation of U.S. patent application Ser. No. 15/712,789, filed Sep. 22, 2017, now U.S. Pat. No. 10,130,235, which is a continuation of U.S. patent application Ser. No. 14/330,527, filed Jul. 14, 2014, now U.S. Pat. No. 9,820,627, which claims the benefit of U.S. Provisional Patent Application No. 61/847,212, filed Jul. 17, 2013, all of which are incorporated herein by reference in their entirety.

BACKGROUND

Surface cleaning apparatuses, such as vacuum cleaners, are provided with a vacuum collection system for creating a partial vacuum to suck up "dry" debris (which may include dirt, dust, soil, hair, and other debris) from a surface to be cleaned and collecting the removed debris in a space provided on the vacuum cleaner for later disposal. Vacuum cleaners are usable on a wide variety of common household surfaces such as soft flooring including carpets and rugs, and hard or bare flooring, including tile, hardwood, laminate, vinyl, and linoleum. Vacuum cleaners are conventionally only configured for "dry" pick-up, and do not distribute or collect liquid.

BRIEF DESCRIPTION

In one aspect the disclosure relates to a vacuum cleaner, including a housing adapted for movement over a surface to be cleaned, a suction nozzle provided with the housing, a separating and collection system provided with the housing, a suction source in fluid communication with the suction nozzle and the separating and collection system, and a fluid dispensing system provided with the housing and including at least one supply container configured to store a supply of a treating agent, a treating agent dispenser in fluid communication with the at least one supply container and configured for receiving the treating agent, a fluid supply conduit in fluid communication with the at least one supply container and the treating agent dispenser, and an air pump for pressurizing at least a portion of the fluid dispensing system and wherein pressurizing the at least a portion of the fluid dispensing system is configured to move the treating agent through the treating agent dispenser.

BRIEF DESCRIPTION OF THE DRAWING(S)

DETAILED DESCRIPTION

Figure 1:
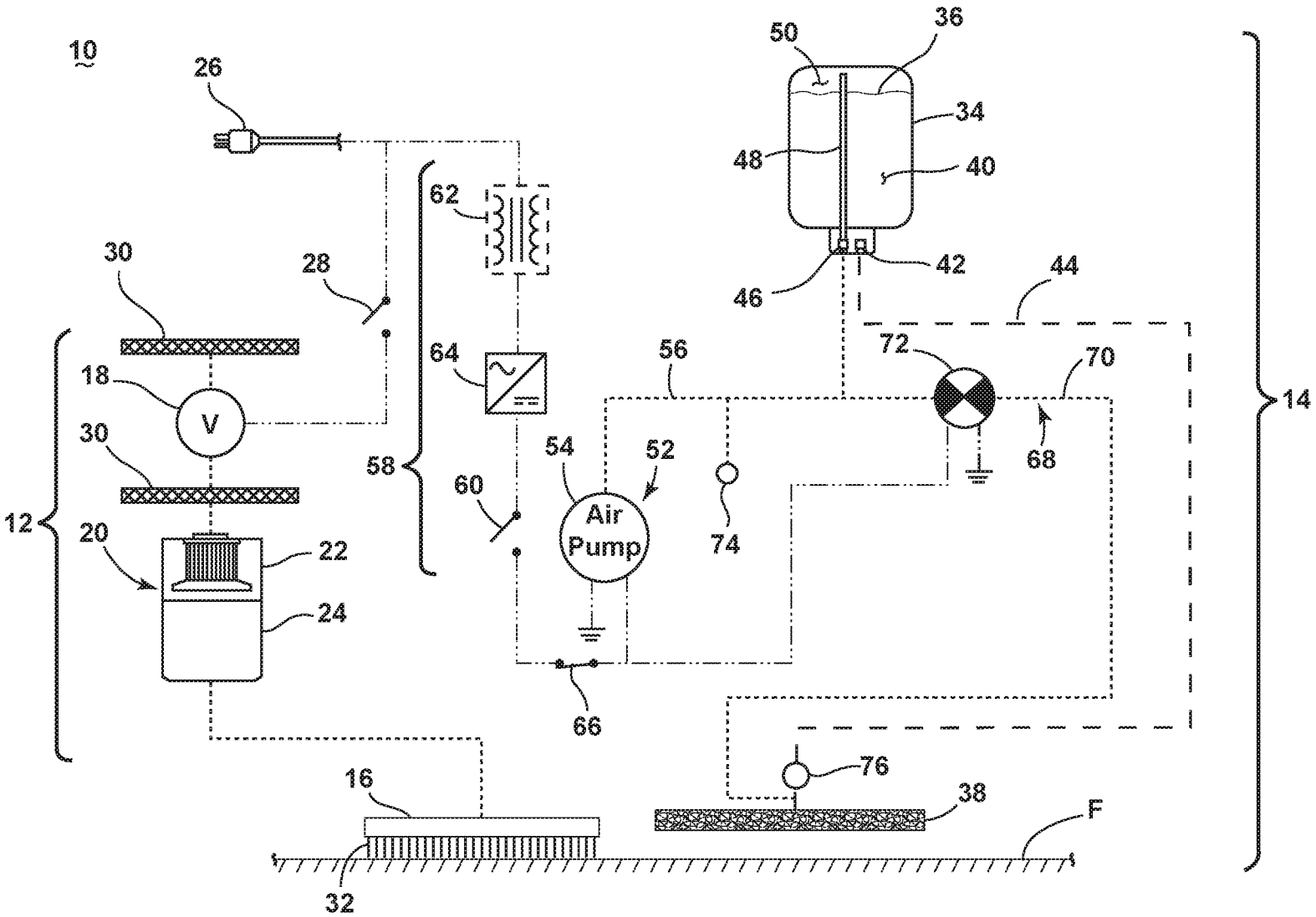
FIG. 1 is a schematic view of a vacuum cleaner according to a first embodiment of the invention, the vacuum cleaner having a dispensing bar for dispensing a liquid treating agent onto a surface to be cleaned.

FIG. 1 is a schematic view of various functional systems of a surface cleaning apparatus in the form of a vacuum cleaner 10. The vacuum cleaner 10 may be substantially similar to a conventional "dry" vacuum cleaner in that it includes a vacuum collection system 12 for creating a partial vacuum to suck up "dry" debris (which may include dirt, dust, soil, hair, and other debris) from a surface to be cleaned and collecting the removed debris in a space provided on the vacuum cleaner 10 for later disposal. However, the vacuum cleaner 10 differs from conventional "dry" vacuum cleaners in that the vacuum cleaner 10 is further provided with a liquid dispensing system 14 for applying a liquid treating agent carried on the vacuum cleaner 10 to the surface to be cleaned. The vacuum cleaner 10 has particular utility in applying a liquid treating agent to soft floor surfaces, such as carpets, rugs, and other textiles. The vacuum cleaner 10 can be provided in the form of an upright vacuum cleaner, a hand-held vacuum cleaning device, or as an apparatus having a floor nozzle or a hand-held accessory tool connected to a canister or other portable device by a vacuum hose. The vacuum collection system 12 can include a suction nozzle 16, a suction source 18 in fluid communication with the suction nozzle 16 for generating a working air stream, and a separating and collection assembly 20 for separating and collecting liquid and debris from the working airstream for later disposal. In one configuration illustrated herein, the collection assembly 20 can include a cyclone separator 22 for separating contaminants from a working airstream and a removable dirt cup 24 for receiving and collecting the separated contaminants from the cyclone separator 22. The cyclone separator 22 can have a single cyclonic separation stage, or multiple stages. In another configuration, the collection assembly 20 can include an integrally formed cyclone separator and dirt cup, with the dirt cup being provided with a structure, such as a bottom-opening dirt door, for contaminant disposal. It is understood that other types of collection assemblies 20 can be used, such as a centrifugal separator, a bulk separators, a filter bag, or a water-bath separator.

The suction source 18, such as a motor/fan assembly, is provided in fluid communication with the separating and collection assembly 20, and can be positioned downstream or upstream of the separating and collection assembly 20. The suction source 18 can be electrically coupled to a power source 26, such as a battery or by a power cord plugged into a household electrical outlet. A suction power switch 28 between the suction source 18 and the power source 26 can be selectively closed by the user upon pressing a vacuum power button (not shown), thereby activating the suction source 18.

The vacuum collection system 12 can also be provided with one or more additional filters 30 upstream or downstream of the separating and collection assembly 20 or the suction source 18. Optionally, an agitator 32 can be provided adjacent to the suction nozzle 16 for agitating debris on the surface to be cleaned so that the debris is more easily ingested into the suction nozzle 16. Some examples of agitators 32 include, but are not limited to, a rotatable brushroll, dual rotating brushrolls, or a stationary brush.

The liquid dispensing system 14 can include at least one container 34 for storing a supply of liquid treating agent 36 on the vacuum cleaner 10 and a dispenser 38 for dispensing the liquid treating agent 36 to the surface to be cleaned. The liquid treating agent 36 can comprise one or more of any suitable treating agents, including, but not limited to, a fragrance, an odor eliminator, a sanitizer, a cleaning composition, a carpet conditioner, or various other treatments and mixtures thereof. For example, the liquid treating agent 36 can comprise an odor eliminator and fragrance, such as Febreze® (active ingredient Hydroxypropyl beta-cyclodextrin), or a sanitizer, such as a hydrogen peroxide-based disinfectant like Accelerated Hydrogen Peroxide (AHP) available from Virox®. Such odor eliminators and fragrances may be useful in particular for treating soft floor surfaces, such as carpets, rugs, and other textiles. The liquid dispensing system 14 can further include multiple containers, each of which can contain a different treating agent.

The container 34 defines a chamber 40 in which the liquid treating agent 36 is stored and includes a liquid outlet 42 in fluid communication with the dispenser 38 via a liquid supply conduit 44. The container 34 further includes an air inlet 46 coupled with an air tube 48 that extends into the chamber 40. Air entering the chamber 40 exits the air tube 48 and creates an air space 50 that pressurizes the liquid treating agent 36. The tank pressure will force the liquid treating agent 36 through the liquid supply conduit 44. The air inlet 46 can include a pressure regulator which does not allow the tank pressure to exceed a predetermined set point.

The container 34 can be a disposable cartridge containing a consumable liquid treating agent 36, such that once the liquid treating agent 36 inside the cartridge is depleted, the cartridge is removed from the vacuum cleaner 10 for disposal or recycling and a new cartridge is mounted on the vacuum cleaner 10. Alternatively, the container 34 can be a refillable tank, such that once the liquid treating agent 36 inside the tank is depleted, the tank is removed from the vacuum cleaner 10, refilled, and replaced on the vacuum cleaner 10.

The liquid dispensing system 14 can further include a flow controller 52 for controlling the flow of liquid treating agent 36 through the liquid supply conduit 44 to the dispenser 38. The flow controller 52 shown herein includes an air pump 54 in fluid communication with the air inlet 46 of the container 34 via an air supply conduit 56. When activated, the air pump 54 pressurizes the container 34 and forces the liquid treating agent 36 out of the liquid outlet 42, through the liquid supply conduit 44, and out of the dispenser 38.

An actuator assembly 58 can be provided to actuate the air pump 54 to dispense liquid treating agent 36 from the dispenser 38. The actuator assembly 58 can include an air pump power switch 60 electrically coupled to the power source 26. The electrical circuit between the power source 26 and the air pump power switch 60 can include an isolation transformer 62 that converts the 120 VAC provided by standard U.S. household electrical outlets to 12 VAC, and a rectifier 64 that converts the 12V AC from the transformer 62 to 6V DC which can be used by the air pump 54. It is understood that the electrical circuit can be configured differently in order to accommodate a different type of air pump 54 or a power source 26 other than a standard U.S. household electrical outlet.

The air pump power switch 60 can be normally open, and can be selectively closed by the user upon pressing a dispensing power button (not shown), thereby activating the air pump 54. While separate switches 28, 60 are shown for the suction source 18 and the air pump 54, an alternative configuration of the vacuum cleaner 10 can provide one switch for activating both the suction source 18 and air pump 54 at the same time. Still another configuration of the vacuum cleaner 10 can use a single multi-position switch for selectively operating the vacuum cleaner 10 in different cleaning modes. For example, the multi-position switch can enable the user to select between a vacuum mode in which only the suction source 18 is activated, a dispensing mode in which only the air pump 54 is activated, or a combination vacuum and dispensing mode in which both the suction source 18 and air pump 54 are activated.

If configured in the form of an upright vacuum cleaner, in which an upper housing having a handle is pivotally mounted to a lower base which moves over the surface to be cleaned, the actuator assembly 58 can further include a handle position switch 66 which is also electrically coupled to the power source 26 and which prevents liquid treating agent 36 from being dispensed when the vacuum cleaner 10 is in the upright, stored position. The handle position switch 66 can be closed when the vacuum cleaner 10 is in the reclined, use position, in which the upper housing is pivoted rearwardly relative to the lower base to form an acute angle with the surface to be cleaned. The handle position switch 66 can be open when the vacuum cleaner 10 is in the upright, stored position, in which the upper housing is oriented substantially vertical relative to the surface to be cleaned.

A ventilation pathway 68 is provided for depressurizing the liquid dispensing system 14 when the vacuum cleaner 10 is not dispensing liquid, and includes vent conduit 70 extending between the air supply conduit 56 and the dispenser 38 and a valve 72 provided in the vent conduit 70 that is normally closed when the air pump 54 is activated, such that the ventilation pathway 68 is closed when the vacuum cleaner 10 is dispensing liquid treating agent 36. The valve 72 can be configured to open when the air pump power switch 60 or handle position switch 66 are open, i.e. when the air pump 54 is off, thereby opening the ventilation pathway 68 and allowing air and any residual liquid to be evacuated to depressurize the liquid dispensing system 14 and prevent leakage from the liquid dispensing system 14 when the vacuum cleaner 10 is not in use. The valve 72 can be an electrically-actuated valve, such as a solenoid valve. A delay timer circuit (not shown) can be associated with the valve 72 to avoid inadvertent or unintentional evacuation of the liquid dispensing system 14.

An air pressure relief 74 is provided in the air supply conduit 56, and is configured to open when pressure within the liquid dispensing system 14 exceeds a predetermined system pressure. For example, a downstream clog in the system 14, such as at the air inlet 46, the liquid outlet 42, the dispenser 38, or elsewhere in the liquid dispensing system 14, can cause pressure to exceed the predetermined system pressure. Under such circumstances, the air pressure relief 74 opens to relieve the pressure build-up. In one non-limiting example, the air pressure relief 74 can be configured to open at a predetermined system pressure, including pressures greater than 55 kPa (approximately 8 psi), although this number can vary based on the design of the system 14.

A liquid check valve 76 is provided in the liquid supply conduit 44, and is configured to open when the liquid dispensing system 14 is pressurized. When the liquid dispensing system 14 is depressurized, the liquid check valve 76 is configured to close, which prevents the liquid treating agent 36 from leaking out of the vacuum cleaner 10 due to gravity.

The dispenser 38 can be a porous body comprising a diffusion media that is configured to diffuse the liquid treating agent through the media at a relatively constant flow rate in order to evenly distribute the treating agent onto the surface to be cleaned. The flow rate of liquid dispensed by the dispenser 38 onto the surface to be cleaned can be relatively low in comparison to extraction cleaners and other liquid-delivering floor cleaners so that significantly less liquid is distributed to the surface during a cleaning operation. In one embodiment, the flow rate for the liquid dispensing system 14 of the vacuum cleaner 10 can be <1% to about 10% of the flow rate for typical extraction cleaners. The flow rate is low enough that the carpet would feel dry or barely damp to the user's touch. In comparison, typical extraction cleaners and other liquid-delivering floor cleaners purposefully wet the carpet to the point that it would be perceived as damp or saturated to the user's touch. In one specific example, the flow rate for the liquid dispensing system 14 of the vacuum cleaner 10 can range from approximately 10 to 36 ml/min. In comparison, a typical extraction cleaner has a flow rate of approximately 300-1400 ml/min.

One example of a suitable diffusion media for the dispenser 38 is a porous plastic material. The porous plastic can have an average pore size ranging from 5 to 500 microns, and more specifically from 7 to 150 microns, in order to achieve a consistent, even flow rate of approximately 10 to 36 ml/min. The diffusion media can be configured with omnidirectional matrices of plastic that form an interconnected network of open-celled pores that allow the liquid treating agent 36 to be distributed consistently and uniformly across the length of the dispenser 38. The diffusion media can be manufactured by sintering polymer pellets. Some specific examples of a suitable porous plastic are polyethylene (PE) and polypropylene (PP). More specifically, a suitable material is available from POREX® (PE or PP).

The vacuum cleaner 10 shown in FIG. 1 can be used to effectively clean a surface by removing debris (which may include dirt, dust, soil, hair, and other debris) from the surface and applying the liquid treating agent to the surface in accordance with the following method. In particular, the method will be described with respect to a soft floor surface comprising carpet. The sequence of steps discussed is for illustrative purposes only and is not meant to limit the method in any way as it is understood that the steps may proceed in a different logical order, additional or intervening steps may be included, or described steps may be divided into multiple steps, without detracting from the invention.

To perform vacuum cleaning, the suction source 18 is coupled to the power source 26. The suction source 18 draws in debris-laden air and/or liquid through the suction nozzle 16 and into the separating and collection assembly 20 where the debris and/or liquid is substantially separated from the working air. The air flow then passes the suction source 18, and through any optional filters 30, prior to being exhausted from the vacuum cleaner 10. During vacuum cleaning, the agitator 32 can agitate debris on the carpet F so that the debris is more easily ingested into the suction nozzle 16. The separating and collection assembly 20 can be periodically emptied of debris and liquid. Likewise, the optional filters 30 can periodically be cleaned or replaced.

To distribute the liquid treating agent 36, the container 34 is coupled to the liquid dispensing system 14 and the air pump 54 is actuated. The air pump 54 pressurizes the container 34 and forces the liquid treating agent 36 to the dispenser 38. The liquid treating agent 36 diffuses through the porous material of the dispenser 38 and is distributed onto the carpet F. The liquid treating agent 36 will substantially remain on the carpet F to treat the carpet F. If the vacuum collection system 12 is activated simultaneously or after the liquid treating agent 36 is dispensed, a very small amount of liquid treating agent 36 may be picked up. However, the amount of liquid treating agent 36 that may be picked up is negligible since so little liquid treating agent 36 is dispensed to the carpet F, such that the vacuum collection system 12 can be configured the same as other conventional "dry" vacuum cleaners that have no special provisions for liquid pick-up, under the assumption that very little to no liquid treating agent 36 is to be collected by the vacuum cleaner 10.

It is noted that while vacuum cleaning is described prior to liquid distribution, these steps can be performed in a different sequence, including multiple alternating steps, overlapping steps, or even sequential steps.

Figure 2:
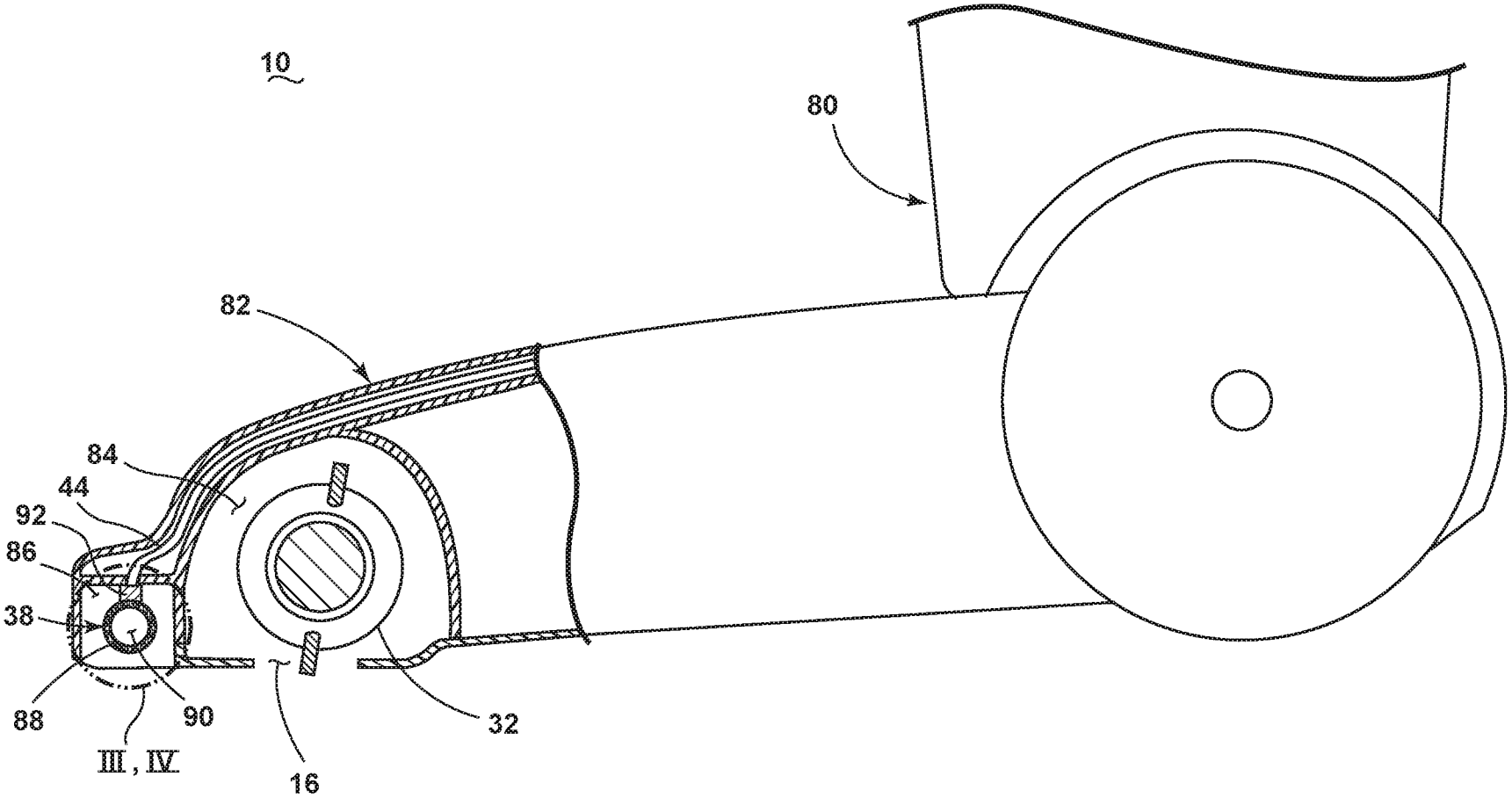
FIG. 2 is a side, partially cut-away view of a vacuum cleaner 10 according to a second embodiment of the invention, partially cut-away to show details of the dispensing bar.

FIG. 2 is a side view of a vacuum cleaner 10 according to a second embodiment of the invention, partially cut-away to show details of the dispenser 38. The second embodiment of the vacuum cleaner 10 includes many of the components of the various functional systems discussed with respect to the embodiment of FIG. 1, and like elements will be identified with the same reference numerals used for the first embodiment.

If configured in the form of an upright vacuum cleaner 10, in which an upper housing 80 is pivotally mounted to a lower base 82 which moves over the surface to be cleaned, at least the suction nozzle 16, agitator 32, and dispenser 38 can be located on the base 82 and positioned adjacent the surface to be cleaned. In the configuration shown in FIG. 2, an agitator chamber 84 is provided in the base 82, and the agitator 32 is mounted within the agitator chamber 84 for rotational movement, and can be coupled to a drive source, such as the motor/fan assembly 18 (FIG. 1) or a separate, dedicated agitator motor (not shown). The agitator 32 is illustrated as a rotatable brushroll; however, it is within the scope of the invention for other types of agitators to be used, such as a stationary brush or dual rotating brushrolls. The suction nozzle 16 is formed as a lower opening on the base 82 and is in fluid communication with the agitator chamber 84. The dispenser 38 can be mounted in a dispensing chamber 86 on the base, and can be located in front of the agitator chamber 84. The dispensing chamber 86 can be fluidly isolated from the agitator chamber 84.

The dispenser 38 can be provided as a dispensing bar 38 having an elongated, rod-shaped body, with a substantially cylindrical outer surface 88 defining one or more hollow space(s) forming an interior liquid cavity 90 inside the dispensing bar 38. The outer surface 88 can be formed from the diffusion media described above. At least one inlet 92 to the dispensing bar 38 fluidly communicates with the liquid supply conduit 44 and can open to the liquid cavity 90 to supply the liquid treating agent 36 to the liquid cavity 90. The inlet 92 can be formed at one end of the dispensing bar 38, or anywhere along the length of the dispensing bar 38. Multiple inlets 92 (not shown) can also be provided, such as at both ends of the dispensing bar 38 or evenly spaced along length of the dispensing bar 38. The dispensing bar 38 does not have a conventional outlet opening for liquid; rather, liquid exits the dispensing bar 38 by diffusing from the liquid cavity 90, through the pores of the diffusion media, and out of the outer surface 88. The air pump also pressurizes the liquid cavity 90, which aids in diffusion. Thus, the diffusion media making up the outer surface 88 forms the outlet for the dispensing bar 38. Cross-sectional shapes other than cylindrical can be used for the dispensing bar 38. In one non-limiting example, the dispensing bar 38 can comprise a solid rod-shaped body without an internal hollow liquid cavity 90 as previously described. Instead, liquid can flow through the solid rod-shaped bar 38 by diffusing through the pores of the diffusion media.

The dispenser 38 on the vacuum cleaner 10 of FIG. 2 can be elevated above the surface to be cleaned, as shown in FIGS. 3A-3D, or can be positioned in register with the surface to be cleaned, as shown in FIGS. 4A-4D. The position of the dispenser 38 can affect the mechanism for dispensing the liquid treating agent 36 onto the surface to be cleaned F. The dispenser 38 can be fixed in one location with respect to the surface to be cleaned, such as in an elevated location as shown in FIG. 3A-3D or a location in register with the surface to be cleaned as shown in FIG. 4A-4D, or can be raised and lowered between different positions, such as by providing a height adjustment mechanism similar to those commonly used for adjusting the height of the suction nozzle with respect to the surface to be cleaned.

Figure 3A:
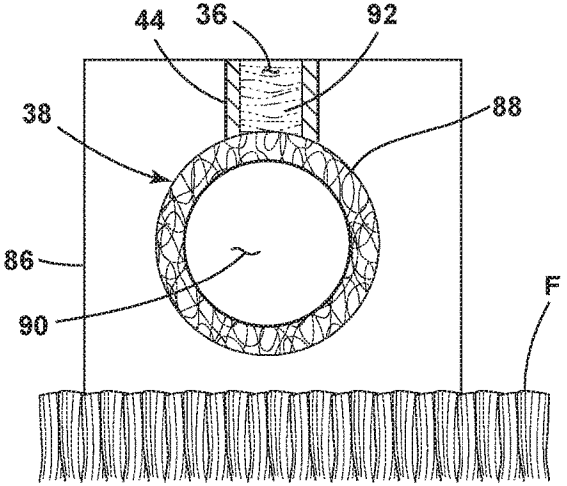
FIGS. 3A-3D illustrate a mechanism for dispensing a liquid treating agent when the dispensing bar is elevated above a surface to be cleaned.
Figure 3B:
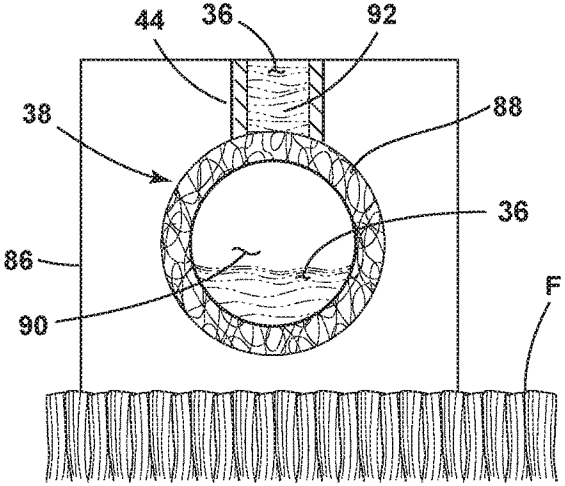
Figure 3C:
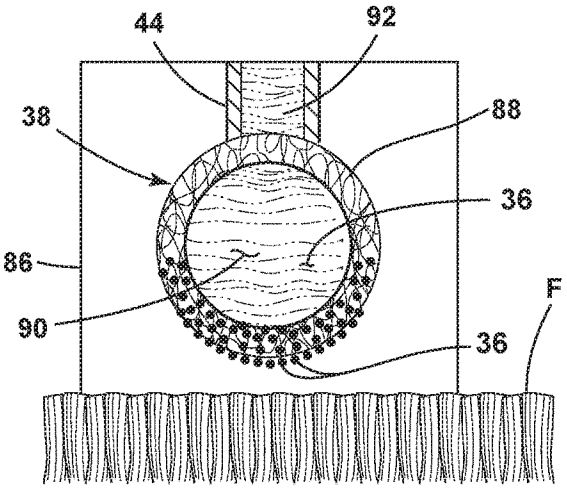
Figure 3D:
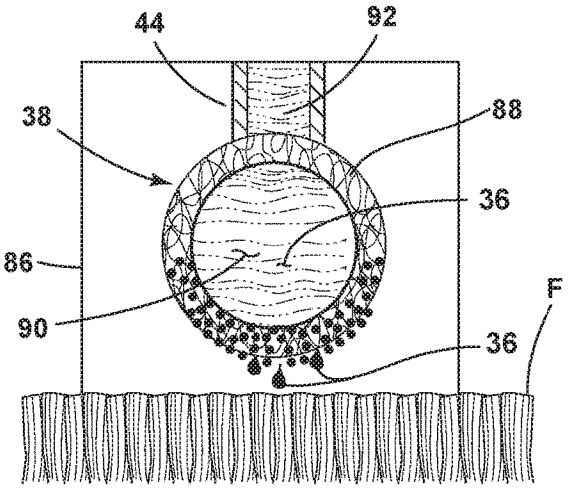

FIGS. 3A-3D illustrate a mechanism for dispensing the liquid treating agent 36 when the dispenser 38 is elevated above the surface to be cleaned F. As shown in FIG. 3A, liquid treating agent 36 is supplied to the inlet 92 of the dispenser 38 via the liquid supply conduit 44. The liquid treating agent 36 enters the dispenser 38 and fills the liquid cavity 90, as shown in FIG. 3B. The pressurized liquid cavity 90 aids in diffusing the liquid treating agent 36 through the outer surface 88 of the dispenser 38, as shown in FIG. 3D. As the liquid treating agent 36 reaches the exterior of the outer surface 88, the liquid may bead up uniformly along the length of the outer surface 88. Gravity may also influence diffusion, and so beading is shown as occurring on the lower portion of the dispenser 38 in FIG. 3C. However, depending on the amount of pressure generated within the liquid cavity 90, the liquid treating agent 36 may diffuse through the entire circumference of the outer surface 88. Furthermore, while the entire liquid cavity 90 is shown as being filled with liquid treating agent 36 in FIG. 3C, it is understood that diffusion may occur when the liquid cavity 90 is less than full. Finally, the liquid treating agent 36 beaded up on the outer surface 88 of the dispenser 38 drips onto the surface to be cleaned F, as shown in FIG. 3D.

Figure 4A:
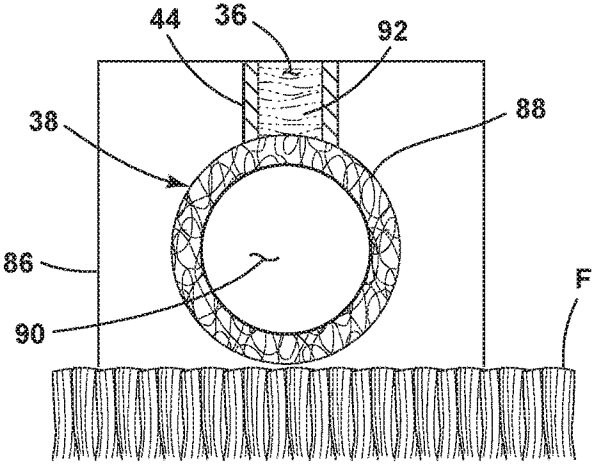
FIGS. 4A-4D illustrate a mechanism for dispensing a liquid treating agent when the dispensing bar is in register with a surface to be cleaned.
Figure 4B:
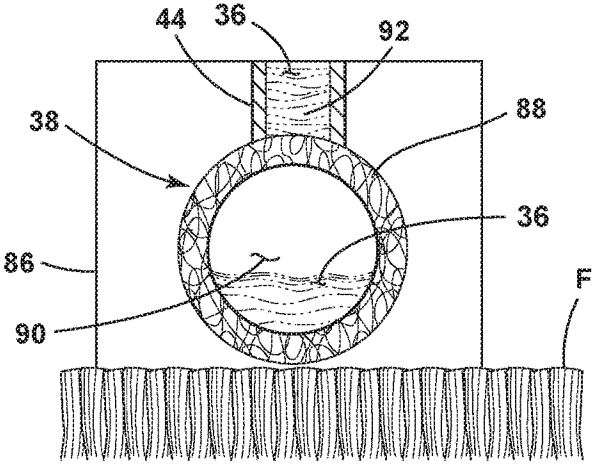
Figure 4C:
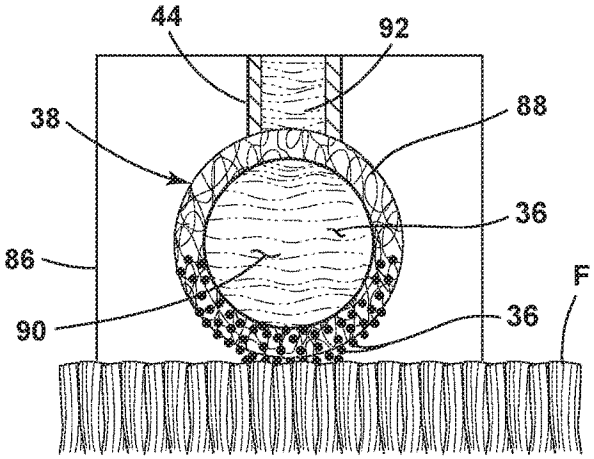
Figure 4D:
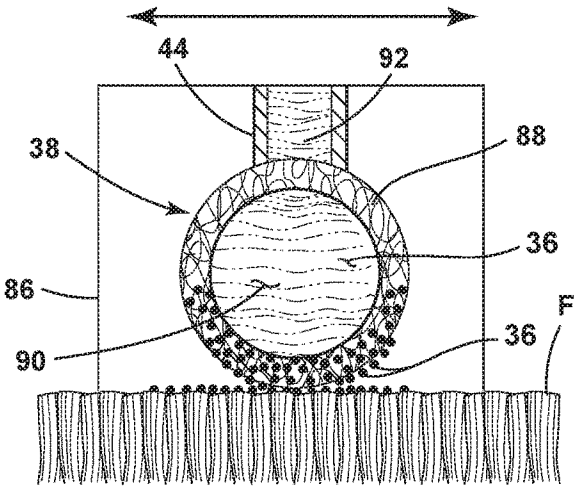

FIGS. 4A-4D illustrate a mechanism for dispensing the liquid treating agent 36 when the dispenser 38 is in register with the surface to be cleaned F. The initial portion of the dispensing mechanism shown in FIG. 4A-4C may be substantially similar to FIG. 3A-3C. FIG. 4D shows that the liquid treating agent 36 beaded up uniformly on the outer surface 88 of the dispenser 38 is wiped onto the surface to be cleaned F as the dispensing chamber 86 moves forward and backward over the surface to be cleaned F, as indicated by the arrow. Wiping the dispenser 38 across the surface can aid in transferring the liquid treating agent 36 deeper within the carpet fibers.

Figure 5:
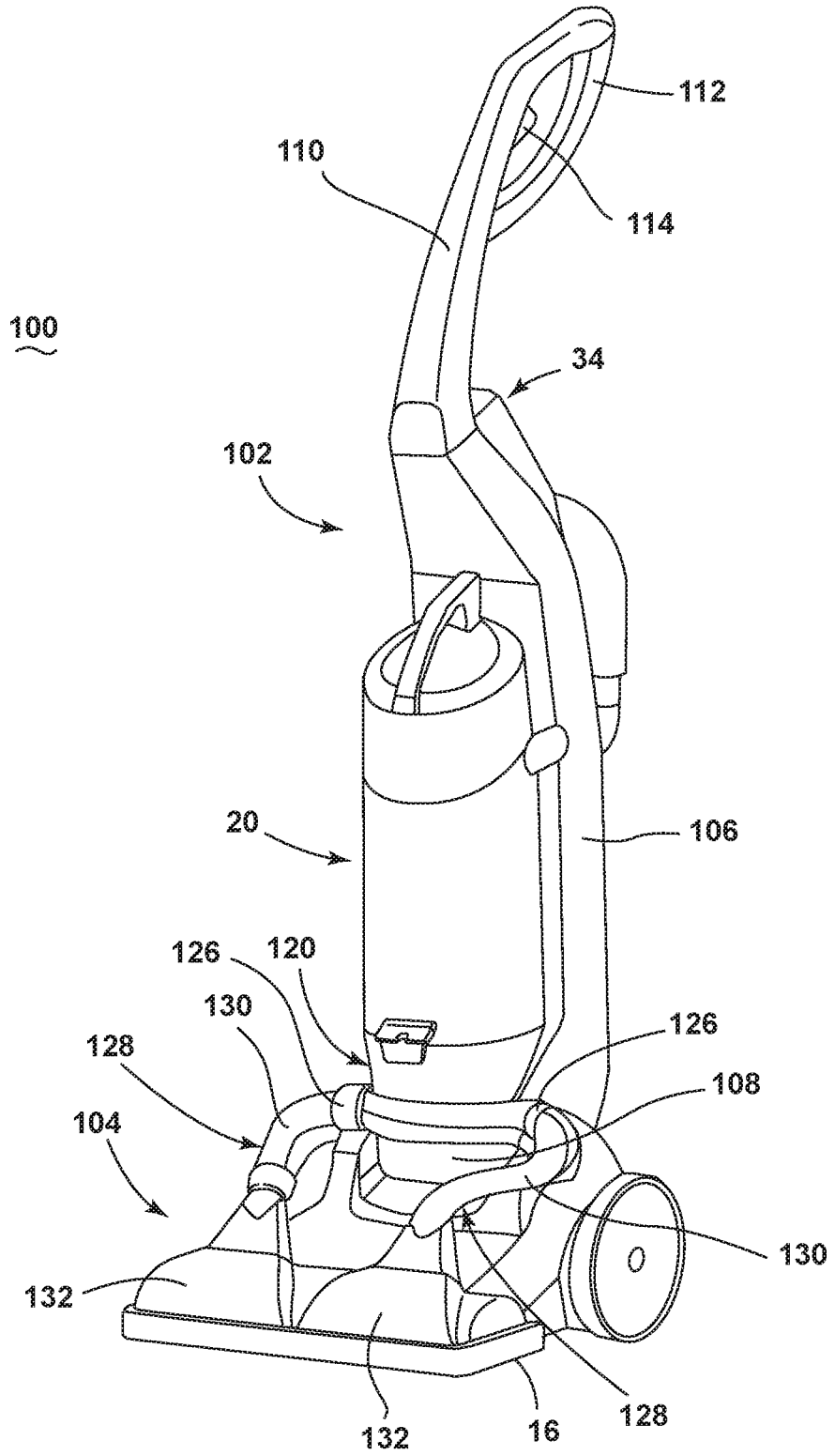
FIG. 5 is a perspective view of a vacuum cleaner according to a third embodiment of the invention.

FIG. 5 is a perspective view of a vacuum cleaner 100 according to a third embodiment of the invention. The third embodiment of the vacuum cleaner includes many of the components of the various functional systems discussed with respect to the embodiment of FIG. 1, and like elements will be identified with the same reference numerals used for the first embodiment. The third embodiment of the vacuum cleaner differs from the first embodiment by the use of flowing air to aid in dispensing liquid treating agent, as will be discussed in more detail below.

The vacuum cleaner 100 comprises an upper housing 102 mounted to a lower base 104 which is adapted to be moved across a surface to be cleaned. The housing 102 and the base 104 may each support one or more components of the vacuum collection system and liquid dispensing system discussed with respect to the embodiment of FIG. 1. The upper housing 102 generally comprises a main support section 106 with the separating and collection assembly 20 on a front portion thereof for separating and collecting debris and liquid from a working airstream for later disposal. A motor cavity 108 is formed at a lower end of the support section 106, below the collection assembly 20, and contains the suction source 18 (FIG. 1). The base 104 includes the suction nozzle 16 that is in fluid communication with the suction source 18 in the motor cavity 108, through the collection assembly 20.

An elongated handle 110 can project from the main support section 106, with a handle grip 112 provided on the end of the handle 110 to facilitate movement of the vacuum cleaner 100 by a user. An actuator 114, such as a trigger, can be provided on the handle grip 112, or elsewhere on the vacuum cleaner 100, and coupled with the air pump power switch 60 (FIG. 1) for controlling the flow of liquid from the container 34. As shown, the container 34 is provided on the rear side of the housing 102, above the separating and collection assembly 20, but can be located elsewhere on the vacuum cleaner 100. The handle position switch 66 (FIG. 1) can be operably coupled with the housing 102 such that the switch 66 is closed when the vacuum cleaner 100 is in the reclined, use position (not shown) and open when the vacuum cleaner 100 is in the upright, stored position shown in FIG. 5.

As illustrated herein, the separating and collection assembly 20 can include an integrally formed cyclone separator and dirt cup, with the dirt cup being provided with a bottom-opening dirt door for contaminant disposal. It is understood that other types of collection assemblies 20 can be used, including those examples given above for the first embodiment. One or more additional filters (not shown) upstream or downstream of the separating and collection assembly 20.

Figure 6:
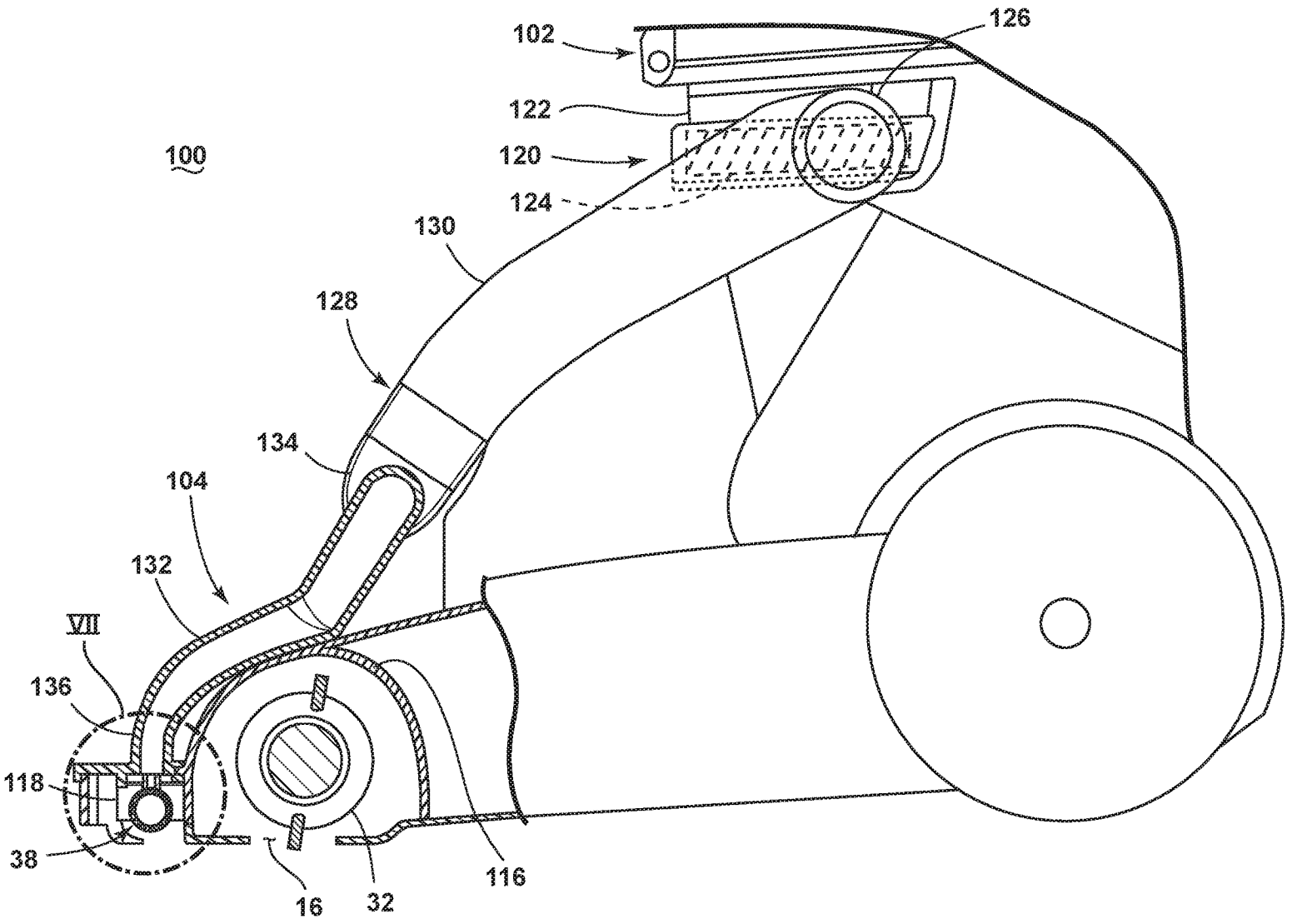
FIG. 6 is a partial sectional view through a lower portion of the vacuum cleaner of FIG. 5.

FIG. 6 is a partial sectional view through the lower portion of the vacuum cleaner 100 of FIG. 5. An agitator chamber 116 is provided in the base 104, and the agitator 32 is mounted within the agitator chamber 116 for rotational movement. The suction nozzle 16 is formed as a lower opening on the base 104 and is in fluid communication with the agitator chamber 116. The dispenser 38 can be mounted in a dispensing chamber 118 on the base 104, which can be located in front of the agitator chamber 116. The dispensing chamber 118 can be fluidly isolated from the agitator chamber 116. The dispenser 38 can extend substantially the entire length of the dispensing chamber 118, and can be elevated above the surface to be cleaned, similar to FIG. 3.

The vacuum cleaner 100 can further include a post-motor filter assembly 120 which is in fluid communication with the suction source 18 for filtering air exhausted from the suction source 18 before the air exits the vacuum cleaner 100. The post-motor filter assembly 120 includes a filter housing 122 that is formed above the motor cavity 108 and a filter media 124 received in the filter housing 122.

The liquid dispensing system of the second embodiment can be substantially similar to the liquid dispensing system 14 shown in FIG. 1, but further uses filtered working exhaust air exiting the post-motor filter assembly 120 to blow over the dispenser 38. The exhaust air stream not only forces liquid beads off the exterior of the dispenser 38, but also blows the liquid across the length and circumference of the dispenser 38 for a more even distribution of liquid across the width of the vacuum cleaner base 104. Using a forced airstream permits the dispenser 38 to be elevated above the surface to be cleaned, while still achieving a uniform distribution of liquid on the outer surface of the dispenser 38. Using filtered working exhaust air exiting the post-motor filter assembly 120 is preferred because unfiltered exhaust air contains fine dust, which would muddy the liquid treating agent 36 when blown across the dispenser 38. Filtered working exhaust air on the other hand is substantially dust-free.

The post-motor filter housing 122 includes at least one outlet port 126 that is in fluid communication with the dispenser 38 via at least one air conduit 128. The air conduit 128 shown herein includes a flexible hose 130 extending from the filter outlet port 126 to an exhaust plenum 132 formed on the base 104. The exhaust plenum 132 includes a narrow inlet portion 134 which couples with the hose 130 and a wider outlet portion 136 which couples with the dispensing chamber 118.

As best shown in FIG. 6, the filter housing 122 includes two outlet ports 126, each with a corresponding hose 130 and exhaust plenum 132. The outlet portion 136 of each plenum 132 can extend substantially half the length of the dispensing chamber 118 such that air is distributed across the length of the dispenser 38 between the two plenums. Alternatively, if one plenum 132 is provided, the outlet portion 136 can extend substantially the entire length of the dispensing chamber 118 such that air is distributed across the length of the dispenser 38 by the single plenum 132.

In the configuration shown, all of the exhaust air from the post-motor filter housing 122 can be provided to the dispensing chamber 118. Alternatively, a portion of the exhaust air can be diverted through the air conduits 128, with another portion of the exhaust air being expelled to the atmosphere through another outlet port (not shown) on the filter housing 122. By controlling the volume of exhaust air provided to the dispensing chamber 118, the volumetric flow rate of the exhaust air flow can be varied, which can control the dispensing rate at the dispenser 38.

Figure 7:
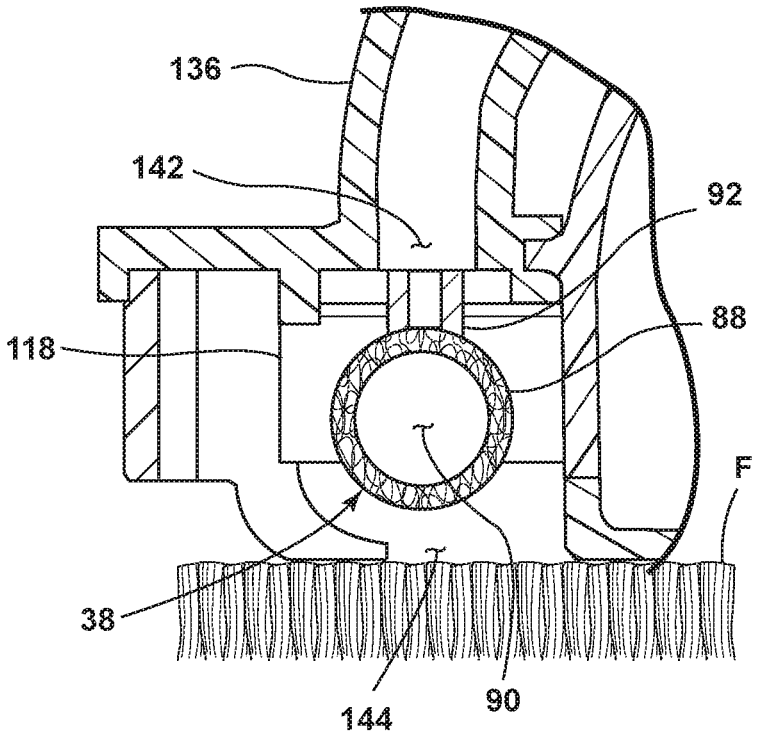
FIG. 7 is a close-up view of section VII of FIG. 6.

FIG. 7 is a close-up view of section VII of FIG. 6. The outlet portion 136 connects with the dispensing chamber 118, and can define an air opening 142 that is spaced from and faces the top of the dispenser 38. The dispensing chamber 118 can further have an open bottom 144 which permits liquid from the dispenser 38 to be dispensed onto the surface to be cleaned. The dispenser 38 can be substantially similar to the dispenser 38 described for FIG. 2-4. The at least one inlet 92 fluidly communicates the liquid supply conduit 44 (FIG. 1) with the liquid cavity 90.

Figure 8:
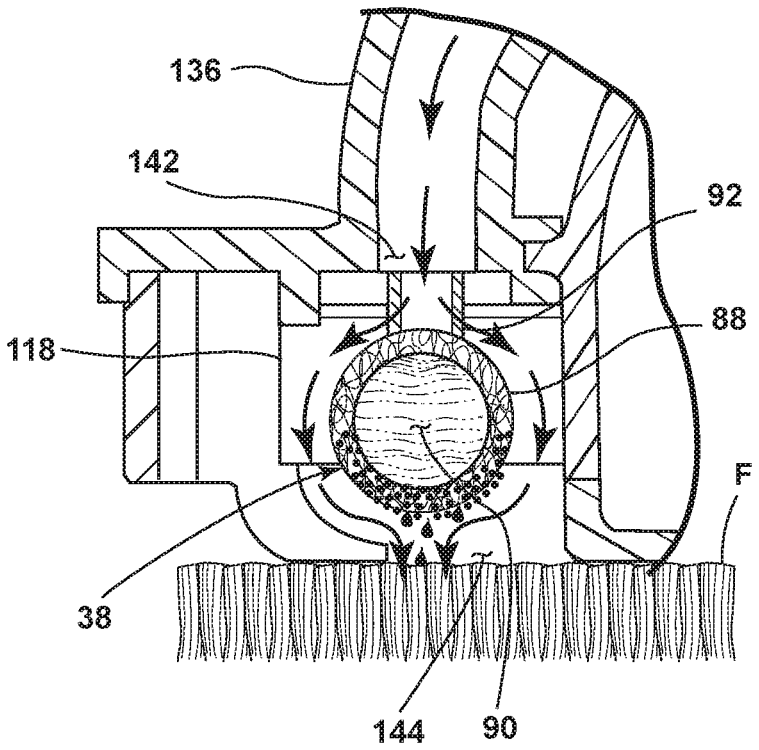
FIG. 8 is a view similar to FIG. 7, showing the dispensing of liquid treating agent from the dispensing bar during operation.

FIG. 8 illustrates the dispensing of liquid treating agent 36 from the dispenser 38 during. During operation, the liquid treating agent 36 is supplied to the inlet 92 of the dispensing bar 38 via the liquid supply conduit 44 (FIG. 1). The liquid treating agent 36 enters the dispensing bar 38 and at least partially or fully fills the liquid cavity 90. The pressurized liquid cavity 90 aids in forcing the liquid treating agent 36 to diffuse through the outer surface 88 of the dispenser 38. As the liquid treating agent 36 reaches the exterior of the outer surface 88, the liquid may bead up uniformly along the length of the outer surface 88. Gravity may also influence diffusion, and so beading is shown as occurring on the lower portion of the dispenser 38 in FIG. 8. However, depending on the amount of pressure generated within the liquid cavity 90, the liquid treating agent 36 may diffuse through the entire circumference of the outer surface 88. Furthermore, while the entire liquid cavity 90 is shown as being filled with liquid treating agent 36 in FIG. 8, it is understood that diffusion may occur when the liquid cavity 90 is less than full.

The pressurized, filtered exhaust air flows, as indicated by arrows in FIG. 8, over the dispenser 38 and blows the beaded up liquid treating agent 36 off the dispenser 38 and distributes it evenly on the surface to be cleaned F.

The vacuum cleaner disclosed herein includes an improved liquid dispensing system. One advantage that may be realized in the practice of some embodiments of the described vacuum cleaner is that a liquid treating agent can be applied to the surface to be cleaned to provide a treatment to the surface in addition to the normal vacuum cleaning performed by the vacuum cleaner. Another advantage that may be realized in the practice of some embodiments of the described vacuum cleaner is that a low amount of liquid treating agent can be evenly applied to the surface to be cleaned, and allowed to remain on the surface rather than being picked up by the vacuum collection system. Any difficulties with evenly distributing the liquid treating agent at the low flow rate across the entire width of the dispensing bar can be overcome by using the porous plastic media(s) described above.

While the vacuum cleaner 10 is discussed herein as having a dispensing system 14 configured to apply a liquid treating agent to the surface to be cleaned, it is also possible for the dispensing system 14 configured to apply other treating agents to the surface to be cleaned. For example, the dispensing system 14 can be a fluid dispensing system configured to apply a fluid treating agent to the surface to be cleaned. As used herein, the term fluid includes both liquid and steam.

While the invention has been specifically described in connection with certain specific embodiments thereof, it is to be understood that this is by way of illustration and not of limitation. Reasonable variation and modification are possible with the scope of the foregoing disclosure and drawings without departing from the spirit of the invention which, is defined in the appended claims. Hence, specific dimensions and other physical characteristics relating to the embodiments disclosed herein are not to be considered as limiting, unless the claims expressly state otherwise.

What is claimed is:

1. A vacuum cleaner, comprising:

a housing adapted for movement over a surface to be cleaned;

a suction nozzle provided with the housing;

a separating and collection system provided with the housing;

a suction source in fluid communication with the suction nozzle and the separating and collection system; and a fluid dispensing system provided with the housing and comprising:

at least one supply container configured to store a supply of a treating agent;

a treating agent dispenser in fluid communication with the at least one supply container and configured for receiving the treating agent;

a fluid supply conduit in fluid communication with the at least one supply container and the treating agent dispenser; and an air pump for pressurizing at least a portion of the fluid dispensing system and wherein pressurizing the at least a portion of the fluid dispensing system is configured to move the treating agent through the treating agent dispenser.

2. The vacuum cleaner of claim 1, further comprising an actuator assembly provided with the housing and operably coupled to the air pump and configured for actuating the air pump.

3. The vacuum cleaner of claim 2 wherein the actuator assembly includes a multi-position switch configured to provide a vacuum mode where only the suction source is activated, a dispensing mode where only the air pump is activated, or a combination vacuum and dispensing mode where both the suction source- and air pump are activated.

4. The vacuum cleaner of claim 1, further comprising a dispensing chamber associated with the housing and wherein the treating agent dispenser is located within the dispensing chamber.

5. The vacuum cleaner of claim 4, further comprising an agitator chamber associated with the housing and wherein an agitator is mounted within the agitator chamber and the agitator chamber and the dispensing chamber are fluidly isolated.

6. The vacuum cleaner of claim 1, further comprising a ventilation pathway fluidly coupled to at least a portion of the fluid dispensing system and a vent configured for depressurizing the fluid dispensing system when the vacuum cleaner is not dispensing fluid.

7. The vacuum cleaner of claim 1, further comprising an air supply conduit in fluid communication between the air pump and the at least one supply container and an air pressure relief vent provided in the air supply conduit and configured to open when pressure exceeds a predetermined system pressure.

8. The vacuum cleaner of claim 7 wherein the air pressure relief vent is configured to open when pressure exceeds 55 kPa.

9. The vacuum cleaner of claim 1, further comprising a fluid check valve provided in the fluid supply conduit upstream of the treating agent dispenser wherein the fluid check valve is configured to open when the fluid dispensing system is pressurized and to close when the fluid dispensing system is depressurized.

10. The vacuum cleaner of claim 1 wherein the fluid dispensing system is configured to dispense treating agent at a flow rate ranging from 10 to 36 mL/min.

11. The vacuum cleaner of claim 1 wherein the air pump is positioned upstream of the at least one supply container.

12. The vacuum cleaner of claim 1 wherein the at least one supply container comprises:

a chamber for holding a fluid;

a fluid outlet in fluid communication with the treating agent dispenser via at least one supply conduit fluidly coupled with the at least one supply container; and an air inlet coupled with an air tube that extends into the chamber;

wherein the air inlet is in fluid communication with the air pump via an air supply conduit.

13. The vacuum cleaner of claim 1 wherein the treating agent dispenser comprises:

an elongated body;

at least one inlet provided on the elongated body in fluid communication with the at least one supply container; and an outlet provided on the elongated body in fluid communication with the at least one inlet.

14. The vacuum cleaner of claim 13 wherein the elongated body is at least partially defined by a porous media configured to diffuse treating agent through the porous media and distribute the treating agent onto the surface to be cleaned.

15. The vacuum cleaner of claim 1 wherein the at least one supply container comprises one of a disposable cartridge or a refillable tank.

16. A vacuum cleaner, comprising:

a lower base adapted for movement over a surface to be cleaned;

a suction nozzle provided with the lower base;

an upper housing having a handle and pivotally mounted to the lower base;

a separating and collection system provided with the upper housing;

a suction source in fluid communication with the suction nozzle and the separating and collection system; and a fluid dispensing system provided with the lower base and comprising:

a supply container configured to store a supply of a treating agent;

a treating agent dispenser located in the el base and in fluid communication with the supply container for receiving the treating agent;

a fluid supply conduit in fluid communication with the supply container and the treating agent dispenser; and an air pump for pressuring at least a portion of the fluid dispensing system to force the treating agent to the treating agent dispenser.

17. The vacuum cleaner of claim 16, further comprising a handle position switch which prevents treating agent from being dispensed when the vacuum cleaner is in an upright, stored position.

18. The vacuum cleaner of claim 16, further comprising an actuator provided on the handle for controlling the flow of fluid from the supply container.

19. The vacuum cleaner of claim 16, further comprising an agitator chamber in fluid communication with the suction nozzle, wherein an agitator is moveably mounted within the agitator chamber.

20. The vacuum cleaner of claim 19, further comprising a dispensing chamber containing the treating agent dispenser and fluidly isolated from the agitator chamber.

* * * * *